US009080415B2

(12) United States Patent
Hallundbæk et al.

(10) Patent No.: US 9,080,415 B2
(45) Date of Patent: Jul. 14, 2015

(54) ANNULAR BARRIER AND ANNULAR BARRIER SYSTEM

(75) Inventors: Jørgen Hallundbæk, Græsted (DK); Paul Hazel, Aberdeen (GB)

(73) Assignee: WELLTEC A/S, Allerød (DK)

( * ) Notice: Subject to any disclaimer, the term of this patent is extended or adjusted under 35 U.S.C. 154(b) by 830 days.

(21) Appl. No.: 13/138,139

(22) PCT Filed: Jan. 12, 2010

(86) PCT No.: PCT/EP2010/050298
§ 371 (c)(1), (2), (4) Date: Jul. 12, 2011

(87) PCT Pub. No.: WO2010/079237
PCT Pub. Date: Jul. 15, 2010

(65) Prior Publication Data

US 2011/0266004 A1 Nov. 3, 2011

(30) Foreign Application Priority Data

Jan. 12, 2009 (EP) ..... 09150385

(51) Int. Cl.

| | |
|---|---|
| ***E21B 33/127*** | (2006.01) |
| ***E21B 34/14*** | (2006.01) |
| ***E21B 33/12*** | (2006.01) |
| ***E21B 33/128*** | (2006.01) |
| ***E21B 43/10*** | (2006.01) |
| ***E21B 34/10*** | (2006.01) |

(52) U.S. Cl.

CPC ..... *E21B 33/1277* (2013.01); *E21B 33/128* (2013.01); *E21B 33/1208* (2013.01); *E21B 33/1285* (2013.01); *E21B 34/10* (2013.01); *E21B 34/14* (2013.01); *E21B 43/103* (2013.01); *E21B 43/105* (2013.01)

(58) Field of Classification Search

None

See application file for complete search history.

(56) References Cited

U.S. PATENT DOCUMENTS

| | | | | | |
|---|---|---|---|---|---|
| 4,230,180 | A | * | 10/1980 | Patton et al. | 166/185 |
| 4,349,204 | A | * | 9/1982 | Malone | 277/334 |
| 4,499,947 | A | | 2/1985 | Zsoka et al. | |
| 5,109,925 | A | | 5/1992 | Stepp et al. | |

(Continued)

FOREIGN PATENT DOCUMENTS

| | | |
|---|---|---|
| CN | 2707948 | 7/2005 |
| GB | 2398312 A | 8/2004 |

OTHER PUBLICATIONS

International Search Report for PCT/EP2010/050298, mailed Mar. 3, 2010.

(Continued)

*Primary Examiner* — Jennifer H Gay
*Assistant Examiner* — Caroline Butcher
(74) *Attorney, Agent, or Firm* — Nixon & Vanderhye, P.C.

(57) ABSTRACT

An annular barrier system for expanding an annular barrier in an annulus between a well tubular structure and an inside wall of a borehole downhole includes an annular barrier having a tubular part for mounting as part of the well tubular structure. The annular barrier further has an expandable sleeve surrounding the tubular part, at least one end of the expandable sleeve being fastened in a fastener of a connection part in the tubular part. The annular barrier system also comprises a tool for expanding the expandable sleeve by letting a pressurized fluid through a passage in the tubular part into a space between the expandable sleeve and the tubular part.

32 Claims, 14 Drawing Sheets

(56) References Cited

U.S. PATENT DOCUMENTS

| | | | | |
|---|---|---|---|---|
| 5,271,469 | A | 12/1993 | Brooks et al. | |
| 5,711,372 | A | 1/1998 | Stokley | |
| 6,253,857 | B1 * | 7/2001 | Gano | 166/386 |
| 6,325,144 | B1 | 12/2001 | Turley et al. | |
| 6,640,893 | B1 * | 11/2003 | Rummel et al. | 166/187 |
| 7,306,033 | B2 | 12/2007 | Gorrara | |
| 2005/0023003 | A1 | 2/2005 | Echols et al. | |
| 2005/0161232 | A1 | 7/2005 | Patel et al. | |
| 2006/0042801 | A1 | 3/2006 | Hackworth et al. | |
| 2006/0169466 | A1 | 8/2006 | Stokley et al. | |
| 2006/0260820 | A1 | 11/2006 | Whitsitt et al. | |
| 2007/0114016 | A1 | 5/2007 | Brezinski et al. | |
| 2009/0090507 | A1 * | 4/2009 | Hill et al. | 166/278 |

OTHER PUBLICATIONS

Written Opinion of the International Searching Authority for PCT/EP2010/050298, mailed Mar. 3, 2010.

Notice of Opposition issued in European Application No. EP09150385.4 dated Nov. 26, 2014.

* cited by examiner

ANNULAR BARRIER AND ANNULAR BARRIER SYSTEM

This application is the U.S. national phase of International Application No. PCT/EP2010/050298, filed 12 Jan. 2010, which designated the U.S. and claims priority to EP Application No. 09150385.4, filed 12 Jan. 2009, the entire contents of each of which are hereby incorporated by reference.

FIELD OF THE INVENTION

The present invention relates to an annular barrier system for expanding an annular barrier in an annulus between a well tubular structure and an inside wall of a borehole or a well downhole, e.g. to seal off the annulus. The annular barrier system comprises an annular barrier having a tubular part for mounting as part of the well tubular structure, the annular barrier further comprising an expandable sleeve surrounding the tubular part, at least one end of the expandable sleeve being fastened by various fastening means to the tubular part.

BACKGROUND ART

In wellbores, annular barriers are used for different purposes, such as for providing a barrier to flow between an inner and an outer tubular structure or an inner tubular structure and the inner wall of the borehole. The annular barriers are mounted as part of the well tubular structure. An annular barrier has an inner wall surrounded by an annular expandable sleeve. The expandable sleeve is typically made of an elastomeric material, but may also be made of metal. The sleeve is fastened at its ends to the inner wall of the annular barrier.

In order to seal off a zone between an inner and an outer tubular structure or a well tubular structure and the borehole, a second annular barrier is used. The first annular barrier is expanded at one side of the zone to be sealed off and the second annular barrier is expanded at the other side of that zone. Thus, the zone is sealed off.

An annular barrier having an expandable metal sleeve is known from U.S. Pat. No. 6,640,893 B1. In its unexpanded condition, the inner wall of the annular barrier and the enclosing expandable sleeve form a chamber. When the annular barrier is installed forming part of the well tubular structure string, the chamber is prefilled with hardening cement through openings in the inner wall of the annular barrier. This is performed in order to prevent fluid flowing inside the well tubular structure during production from entering the openings and thus the chamber.

The sleeve is expanded by injecting a second cement compound into the chamber through the openings and thus expanding the sleeve by breaking the hardened cement. If the chamber had been filled with fluid and not hardening cement, the second cement compound would be diluted and thus be unable to harden subsequently. In order to provide the second cement compound with sufficient pressure, the well tubular structure is closed off at the end most distant from the surface and the well tubular structure is filled with the second cement compound.

When mounting the well tubular structure string, annular barriers can be inserted at regular intervals. Some annular barriers may be used to fasten or centralise the well tubular structure string in the borehole, whereas others await a later use, such as sealing off a zone. Cement prefilled in the chambers may thus have to wait for expansion at the risk of losing its properties before use.

When the annular barriers of U.S. Pat. No. 6,640,893 B1 are used for centralising or sealing off a production zone, the second cement compound filling up the well tubular structure and, subsequently, also the plug have to be removed. This is a costly procedure requiring several steps subsequent to the step of expanding the sleeve.

Furthermore, the first cement compound may close the opening so that the opening has to be cleaned before injecting the second cement compound. The opening may also be filled with contaminants or fragments comprised in the fluid running in the well tubular structure during production.

SUMMARY OF THE INVENTION

It is an object of the present invention to wholly or partly overcome the above disadvantages and drawbacks of the prior art. More specifically, it is an object to provide an improved annular barrier system enabling an easier and more reliable expansion of an annular barrier than in the solutions of prior art.

Furthermore, it is an object to provide a more reliable annular barrier.

The above objects, together with numerous other objects, advantages, and features, which will become evident from the below description, are accomplished by a solution in accordance with the present invention by an annular barrier system (100) for expanding an annular barrier (1) in an annulus (2) between a well tubular structure (3) and an inside wall (4) of a borehole downhole, comprising:

an annular barrier (1) having a tubular part (5) for mounting a part of the well tubular structure, the annular barrier further comprising an expandable sleeve (6) surrounding the tubular part, at least one end (7) of the expandable sleeve being fastened by means of a fastening means (8) of or to a connection part (9) in the tubular part, and the expandable sleeve is made of metal, wherein the annular barrier has a valve (13) for controlling the passage of pressurised fluid into the space between the expandable sleeve and the tubular part.

By having a valve, the metal sleeve is expandable from within the tubular structure by means of other fluids than cement as the valve is closed again subsequent to the filling of the space between the sleeve and the tubular structure. If the pressure increases outside the sleeve in the annulus surrounding the sleeve, the valve is reopened by means of a tool, and the pressure in the space increases correspondingly. The expansion of the sleeve is performed by building up a pressure opposite the valve by means of a tool or a drill pipe assembly, or by pressurising the well from above.

In one embodiment, the annular barrier system may further comprise a tool for expanding the expandable sleeve by letting a pressurised fluid through the valve in a passage in the tubular part into the space between the expandable sleeve and the tubular part.

In another embodiment the annular barrier system for expanding an annular barrier in an annulus between a well tubular structure and a borehole downhole, may comprise an annular barrier having a tubular part for mounting as part of the well tubular structure, the annular barrier further comprising an expandable sleeve surrounding the tubular part, each end of the expandable sleeve being fastened in a fastening means of a connection part in the tubular part, and a tool for expanding the expandable sleeve by letting a pressurised fluid through a passage in the tubular part into a space between the expandable sleeve and the tubular part.

The annular barrier may have a valve for controlling the passage of pressurised fluid into the space between the expandable sleeve and the tubular part. Furthermore, the tubular part may have a wall thickness, and the connection part projects outwardly from the tubular part increasing the wall thickness.

In addition, the tubular part may have a wall thickness, and the connection part may comprise a layer on its surface facing the sleeve increasing its wall thickness.

This layer may be made of different material than the tubular part and/or the connection part.

In one embodiment, the sleeve may have two ends made of a different material than a centre part of the sleeve.

These two ends may have been welded to the centre part.

Furthermore, the two ends may have an inclined surface corresponding to an inclined surface of the centre part of the sleeve.

In one embodiment, the annular barrier system may comprise at least two annular barriers positioned at a distance from each other along the well tubular structure.

According to the invention, the at least two annular barriers may be fluidly connected via a fluid connection.

In one embodiment, the fluid connection may be a tube running along a longitudinal extension of the borehole.

In another embodiment, the fluid connection may be a bore within the well tubular structure.

The tool may have means for adjusting the valve from one position to another.

Moreover, the tool may have an isolation device for isolating a first section between an outside wall of the tool and an inside wall of the well tubular structure outside the passage of the tubular part.

When isolating a section outside the passage of the tubular part, it is no longer necessary to fill up the whole well tubular structure or to have an additional plug as in prior art solutions.

The isolation device of the tool may have at least one sealing means for sealing against the inside wall of the well tubular structure on each side of the valve in order to isolate the first section inside the well tubular structure.

In addition, the tool may have pressure delivering means for taking in fluid from the borehole and for delivering pressurised fluid to the first section. The pressure delivering means may be a stroker tool.

Thus, the fluid surrounding the tool can be used for injection into the first section.

The tool may have means for connection to a drill pipe, and it may have packers for closing an annular area.

In one embodiment, the tool may have more than one isolation device.

The advantage of having more than one isolation device is that it is possible to expand two sleeves at a time or measure at two positions at a time.

Pressurised fluid delivery could also be facilitated by simply applying pressure to the well tubular structure from the surface via a drill pipe or coiled tubing.

Also, the tool may have means for connecting to the drill pipe or coiled tubing so that the tool uses the pressurised fluid from drill pipe or coiled tubing.

In addition, the tool may have an anchor tool for anchoring the tool inside the well tubular structure.

Moreover, the tool may have means for measuring the flow, temperature, pressure, density, water hold-up, and/or expansion of the sleeve.

In one embodiment, the tool may further have a recording and/or transmitting device for recording and/or transmitting data from measurements performed by the tool.

In addition, the tool may be connected to a downhole tractor in order to move the tool in the well tubular structure.

The pressurised fluid may be fluid from the well tubular structure or surrounding the well tubular structure, cement, or a polymer, or a combination thereof. In one embodiment, the tool may comprise a reservoir with the pressurised fluid.

The invention also relates to an annular barrier comprising a tubular part for mounting as part of a well tubular structure in a borehole, the annular barrier comprising an expandable sleeve surrounding the tubular part, each end of the expandable sleeve being fastened in a fastening means of a connection part in the tubular part, wherein the annular barrier may comprise a valve for controlling a passage of pressurised fluid into a space between the expandable sleeve and the tubular part.

In one embodiment of the annular barrier or the annular barrier system, the valve may be positioned in at least one of the connection part.

In another embodiment of the annular barrier or the annular barrier system, the valve may be a one-way valve or a two-way valve.

Also, the valve may be a three-way valve for, in a first position, letting fluid into the space between the expandable sleeve and the tubular part, in a second position letting fluid into the annulus between the well tubular structure and the borehole, and in a third position stopping the fluid from flowing.

In yet another embodiment of the annular barrier or the annular barrier system, the valve in a first position lets fluid into the space between the expandable sleeve and the tubular part, in a second position lets fluid into the annulus between the well tubular structure and the borehole, in a third position stops the fluid from flowing, and in a fourth position lets fluid flow between the annulus and the space.

Moreover, at least one of the fastening means may be slidable in relation to the connection part of the tubular part of the annular barrier.

In addition, at least one sealing element, such as an O-ring, may be arranged between the slidable fastening means and the connection part.

In one embodiment of the annular barrier or the annular barrier system, more than one sealing elements may be arranged between the slidable fastening means and the connection part.

At least one of the fastening means may be fixedly fastened to the connection part or be part of the connection part.

In another embodiment of the annular barrier or the annular barrier system, both of the fastening means may be fixedly fastened with its connection part or be part of its connection part.

In one embodiment of the annular barrier or the annular barrier system, the fastening means may have a projecting edge part which projects outwards from the connecting part.

Having a part of the fastening means bending outwards means that the fastening means does not have a sharp edge which may cause the sleeve to crack close to the fastening means when expanded.

In one embodiment of the annular barrier or the annular barrier system, the expandable sleeve may be made of metal.

In another embodiment of the annular barrier or the annular barrier system, the expandable sleeve may be made of polymers, such as an elastomeric material, silicone, or natural or syntactic rubber.

The expandable sleeve may have a thickness of less than 10% of its length.

In addition, the expandable sleeve may be capable of expanding to at least a 10% larger diameter, preferably at least a 15% larger diameter, more preferably at least a 30% larger diameter than that of an unexpanded sleeve.

Furthermore, the expandable sleeve may have a wall thickness which is thinner than a length of the expandable sleeve, wherein the expandable sleeve may have a thickness of less than 25% of its length, preferably less than 15% of its length, more preferably less than 10% of its length In one embodiment of the annular barrier or the annular barrier system, the expandable sleeve may have a varying thickness.

The invention also relates to use of the annular barrier as described above in a well tubular structure for insertion in a borehole.

Moreover, the invention relates to a tool as described above.

The invention further relates to an expansion method for expanding an annular barrier as described above inside a borehole comprising well fluid having a pressure, comprising the following steps:

- placing a tool outside the passage of the tubular part of the annular barrier,
- isolating the passage by means of the isolation device of the tool, and
- increasing the pressure of the well fluid inside the isolation device in order to expand the sleeve of the annular barrier.

In addition, the invention relates to an expansion method for expanding an annular barrier as described above, comprising the following steps:

- placing a tool outside the passage of the tubular part of the annular barrier, and
- opening the valve in the connection part of the annular barrier so that pressurised fluid in coiled tubing, in a chamber in the tool, or in an isolated section between an outside wall of the tool and an inside wall of the well tubular structure, is let into the space between the tubular part and the expandable sleeve of the annular barrier in order to expand the sleeve.

The invention also relates to a production method for producing oil or the like fluid through a well tubular structure having a production zone in which the well tubular structure has perforations, a screen, or the like and at least two annular barriers as described above, comprising the following steps:

- expanding a first annular barrier at one side of the production zone of the well tubular structure,
- expanding a second annular barrier at another of the production zone of the well tubular structure, and
- letting fluid into the well tubular structure through the production zone.

In addition, the production method may comprise the step of opening a valve in each annular barrier allowing pressurised fluid to flow from annulus zones adjacent to the production zone into the cavity of the annular barriers.

Moreover, the invention relates to a fracturing method for fracturing a formation surrounding a borehole for producing oil or the like fluid through a well tubular structure having a production zone and at least one annular barrier as described above, comprising the following steps:

- expanding a first annular barrier at one side of the production zone of the well tubular structure,
- expanding a second annular barrier at another of the production zone of the well tubular structure,
- injecting pressurised fluid into the production zone through an opening in the tubular part of the annular barrier, and
- opening a valve in each annular barrier allowing pressurised fluid to flow from the production zone into the cavity of the annular barriers.

Finally, the invention relates to a testing method for measuring pressure in a production zone sealed off by two annular barriers as described above, comprising the following steps:

- placing a tool outside the valve of annular barrier,
- adjusting the valve so that fluid in the production zone can flow in through the passage, and
- measuring the pressure of the fluid from the production zone.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Annular barriers 1 according to the present invention are typically mounted into the well tubular structure string before lowering the well tubular structure 3 into the borehole downhole. The well tubular structure 3 is constructed by well tubular structure parts put together as a long well tubular structure string. Often, the annular barriers 1 are mounted in between the well tubular structure parts when mounting the well tubular structure string.

Figure 1:
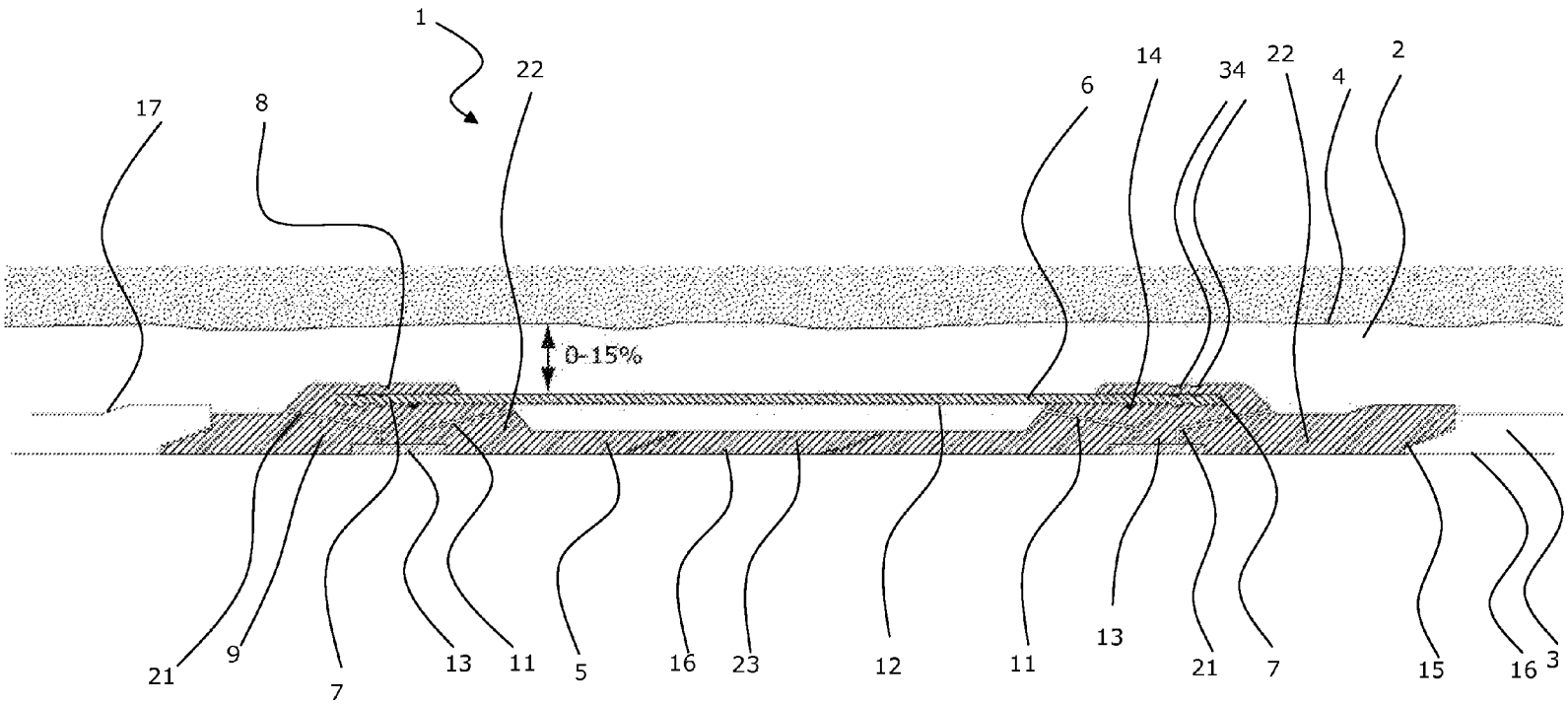
FIG. 1 shows one embodiment of an annular barrier according to the present invention in its unexpanded position.

The annular barrier 1 is used for a variety of purposes, all of which require that an expandable sleeve 6 of the annular barrier 1 is expanded so that the sleeve abuts the inside wall 4 of the borehole. The annular barrier 1 comprises a tubular part 5 which is connected to the well tubular structure 3 as shown in FIG. 1, e.g. by means of a thread connection 15. Thus, the tubular part 5 and the well tubular structure part 3 together form the inside wall 16 of the well tubular structure. The annular barrier 1 of FIG. 1 is shown in its unexpanded and relaxed position creating a cavity 12 between the expandable sleeve 6 and the tubular part 5 of the annular barrier 1. In order to expand the expandable sleeve 6, pressurised fluid is injected into the cavity 12 until the expandable sleeve abuts the inside wall 4 of the borehole.

Figure 11:
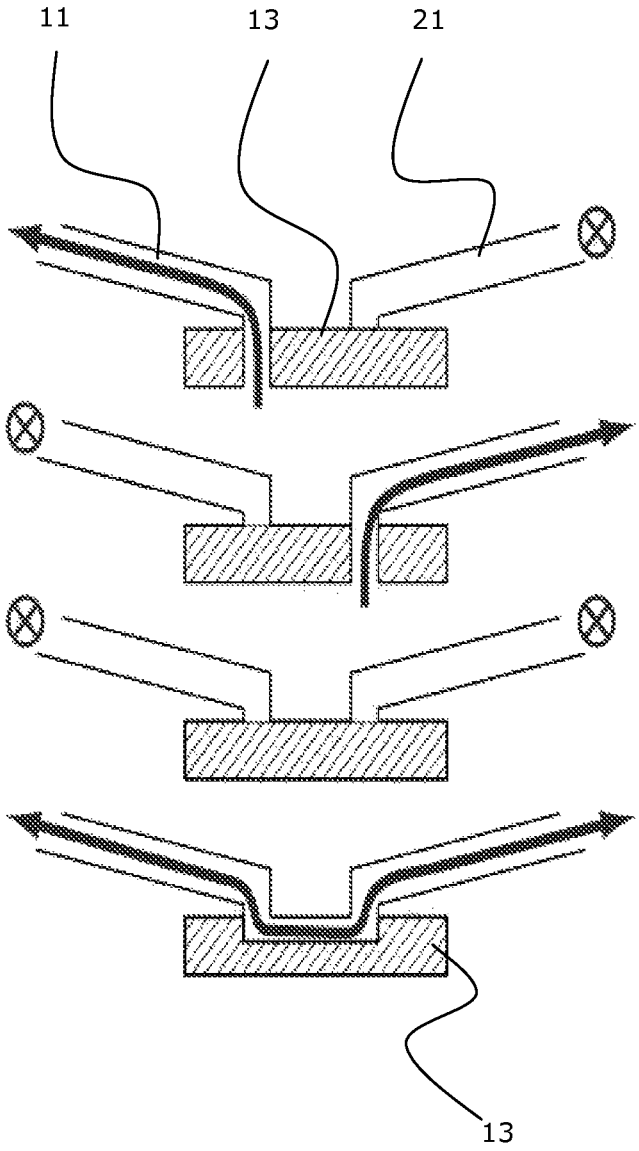
FIG. 11 shows four positions which a valve in an annular barrier of the present invention may have.

In this embodiment, the annular barrier 1 has a valve 13 which is shown in its closed position. This embodiment of the valve 13 has four positions as shown in FIG. 11. In position A, the valve 13 has an open passage 11 from the inside of the well tubular structure 3 to the space 12 between the expandable sleeve 6 and the tubular part 5 while having a closed passage 21 from the inside of the well tubular structure to the annulus 2 between the outside wall 17 of the well tubular structure and the inside wall 4 of the borehole or formation. In position B, the passage 11 from the inside of the well tubular structure 3 to the space 12 between the expandable sleeve 6 and the tubular part 5 is closed while the passage 21 from the inside of the well tubular structure to the annulus 2 between the outside wall 17 of the well tubular structure and the inside wall 4 of the borehole or formation is open. In its closed position C, the valve 13 also closes the passage 21 from the inside of the well tubular structure 3 to the annulus 2 between the outside wall 17 of the well tubular structure and the inside wall 4 of the borehole or formation. In position D, the valve 13 has an open passage 11 from the inside of the well tubular structure 3 to the space 12 between the expandable sleeve 6 and the tubular part 5 while also having an open passage 21 from the inside of the well tubular structure to the annulus 2 between the outside wall 17 of the well tubular structure and the inside wall 4 of the borehole or formation. Thus, the position D results in a fluid connection from the annulus 2 to the space 12.

Having a valve 13 in the annular barrier 1 enables other fluids than cement, such as the fluid present in the well or sea water, to be used for expanding the expandable sleeve 6 of the annular barrier.

The expandable sleeve 6 is fastened in a fastening means 8 of a connection part 9 of the annular barrier 1. The expandable sleeve 6 is fixedly fastened in the fastening means so that the ends 7 of the expandable sleeve do not move in relation to the fastening means 8. Furthermore, in this embodiment, the fastening means 8 is a part of the connection part 9. In another embodiment, the fastening means 8 is fixedly connected to the connection part 9. Thus, both of the fastening means 8 may be fixedly fastened to its connection part 9 or be a part of its connection part.

As can be seen, the expandable sleeve 6 is a thin-walled tubular structure inserted into the fastening means 8. Subsequently, the fastening means 8 has been embossed changing the form of the fastening means and the ends 7 of the expandable sleeve, thus mechanically fastening them in relation to one another. In order to seal the connection between the expandable sleeve 6 and the fastening means 8, a sealing element 14 is arranged between them.

The tubular part 5 of the annular barrier 1 is mounted from two end parts 22 and an intermediate part 23 which have been joined by means of threads. In this embodiment, the end parts 22 are the same as the connection parts 9. However, in another embodiment, the ends parts 22 are fixedly connected to the connection parts 9.

Figure 2:
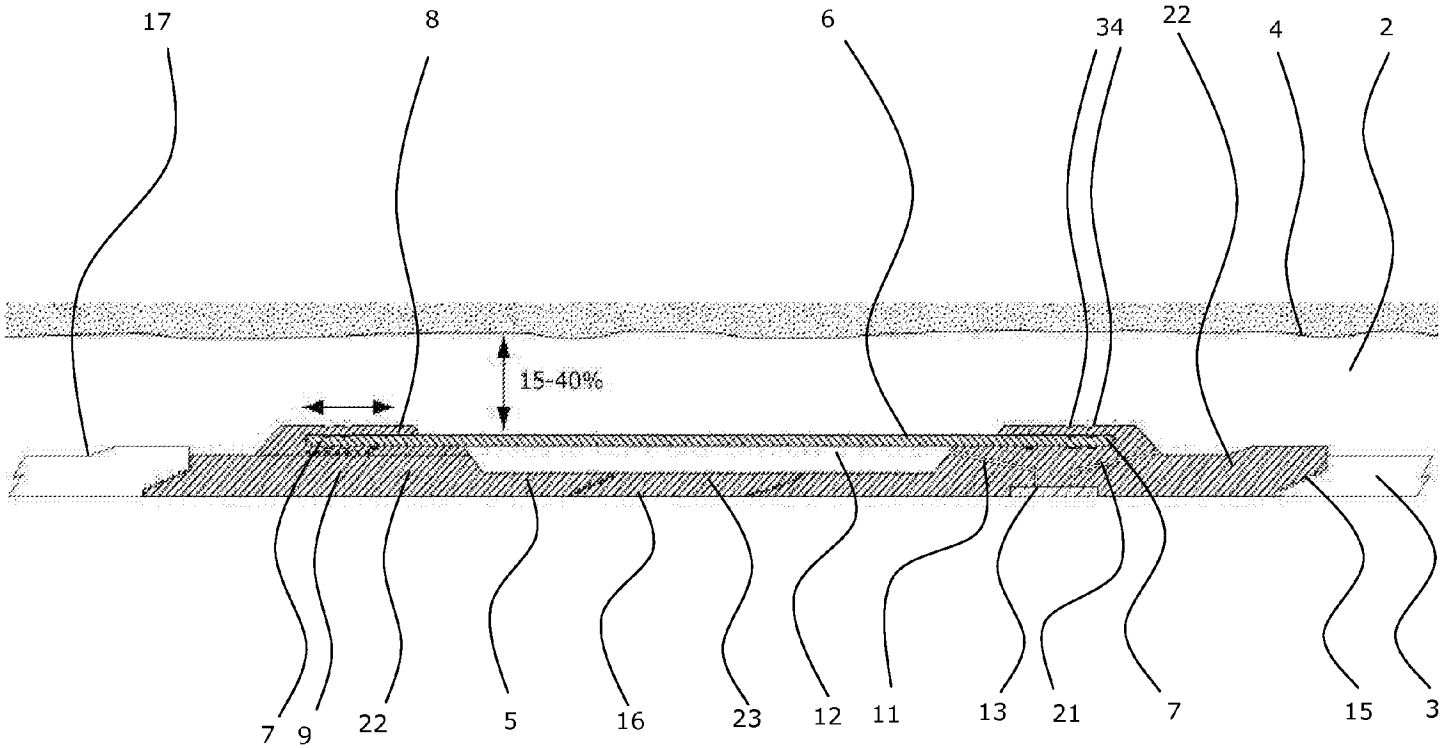
FIG. 2 shows another embodiment of the annular barrier in its unexpanded position.

Another embodiment of the annular barrier 1 is shown in FIG. 2. In one end of the annular barrier 1, the fastening means 8 in which the sleeve 6 is fastened is slidably connected to the connection part 9 (illustrated by the arrows). When the expandable sleeve 6 is expanded in a transverse direction, the sleeve will tend to shorten in its longitudinal direction—if possible. By having a slidable connection, the sleeve 6 is allowed to reduce its longitudinal extension, resulting in a possibly larger expansion since the sleeve is not stretched as much as when the sleeve is fixedly connected to the connection part 9.

In order to seal the slidable connection also during any sliding movements, sealing elements 14 are arranged between the sliding fastening means 8 and the connection part 9.

In FIG. 2, the annular barrier 1 has one valve 13 arranged in the connection part 9 of the annular barrier in the transition between the cavity 12 and the annulus 3. In another embodiment, the connection part 9 of the sliding connection may also be provided with a valve 13. Thus, the passages 11, 21 may have to be elongated in order to compensate for length necessitated by the sliding ability of the connection.

An annular barrier 1 with a slidable connection between the sleeve 6 and the connection part 9 results in an increase of the expansion ability of the sleeve with up to 100% in relation to an annular barrier without any slidable connections.

In another embodiment, the annular barrier 1 has two slidable connections, increasing the expansion ability of the sleeve 6 even more.

Figure 3:
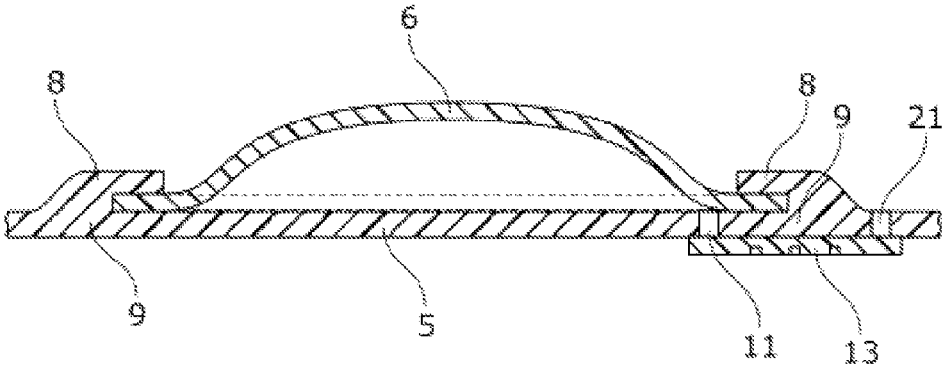
FIG. 3 shows yet another embodiment of the annular barrier in its expanded position.

In FIG. 3, the annular barrier 1 of the invention has a valve 13 which is slidable between a position where the first passage 11 from the inside of the well tubular structure 3 and the cavity 12 is open and the second passage 21 from the inside of the well tubular structure and the annulus 2 is closed to a second position where the first passage is closed and the second is open. As shown, the valve 13 also has a third position in which both passages 11, 21 are closed.

In FIG. 3, the expandable sleeve 6 is in its expanded condition and the unexpanded condition of the expandable sleeve is illustrated by a dotted line. As can be seen, in its unexpanded position, the expandable sleeve 6 follows the surface of the tubular part 5 so that only a narrow space 12 is created between the two. The tubular part 5 thus does not have any indentation, and the cavity 12 is created solely by expansion of the sleeve 6.

Figure 4:
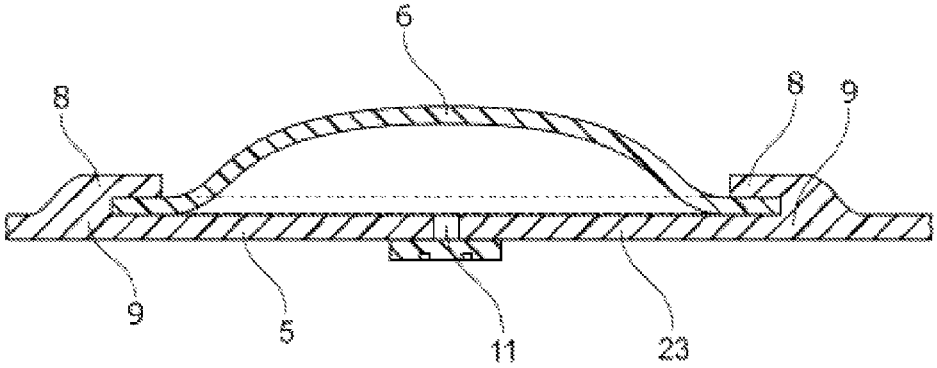
FIG. 4 shows a further embodiment of the annular barrier in its expanded position.

As can be seen from FIG. 4, the annular barrier 1 may also have a valve 13 placed in the part between the two connection parts 9. Such a valve may be a one-way valve or a two-way valve.

Also, the valve 13 of the annular barrier 1 may be a three-way valve which in a first position lets fluid into the space 12 between the expandable sleeve 6 and the tubular part 5, in a second position lets fluid into the annulus 2 between the well tubular structure 3 and the borehole, and in a third position stops the fluid from flowing.

The expandable sleeve 6 of the annular barrier 1 has a length extending along the longitudinal extension of the well tubular structure 3. The expandable sleeve 6 has a wall thickness which is thinner than its length. In one embodiment, the expandable sleeve 6 has a thickness of less than 25% of its length, preferably less than 15% of its length, more preferably less than 10% of its length.

When the expandable sleeve 6 of the annular barrier 1 is expanded, the diameter of the sleeve is expanded from its initial unexpanded diameter to a larger diameter. In an embodiment of the invention, the expandable sleeve 6 is capable of expanding to a diameter which is at least 10% larger than its initial diameter, preferably at least 15% larger, more preferably at least 30% larger.

Figure 9:
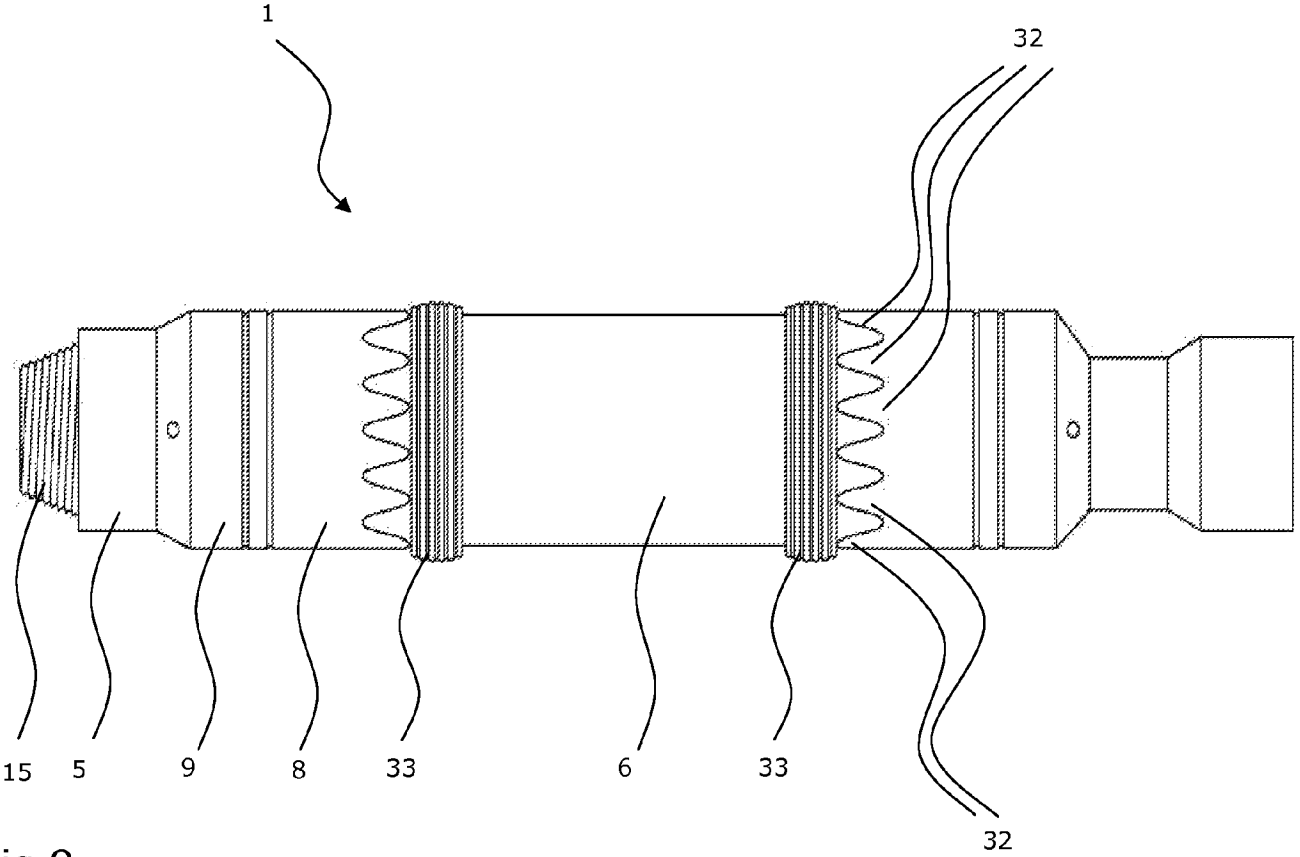
FIG. 9 shows an embodiment of the annular barrier seen from outside the annular barrier.
Figure 10:
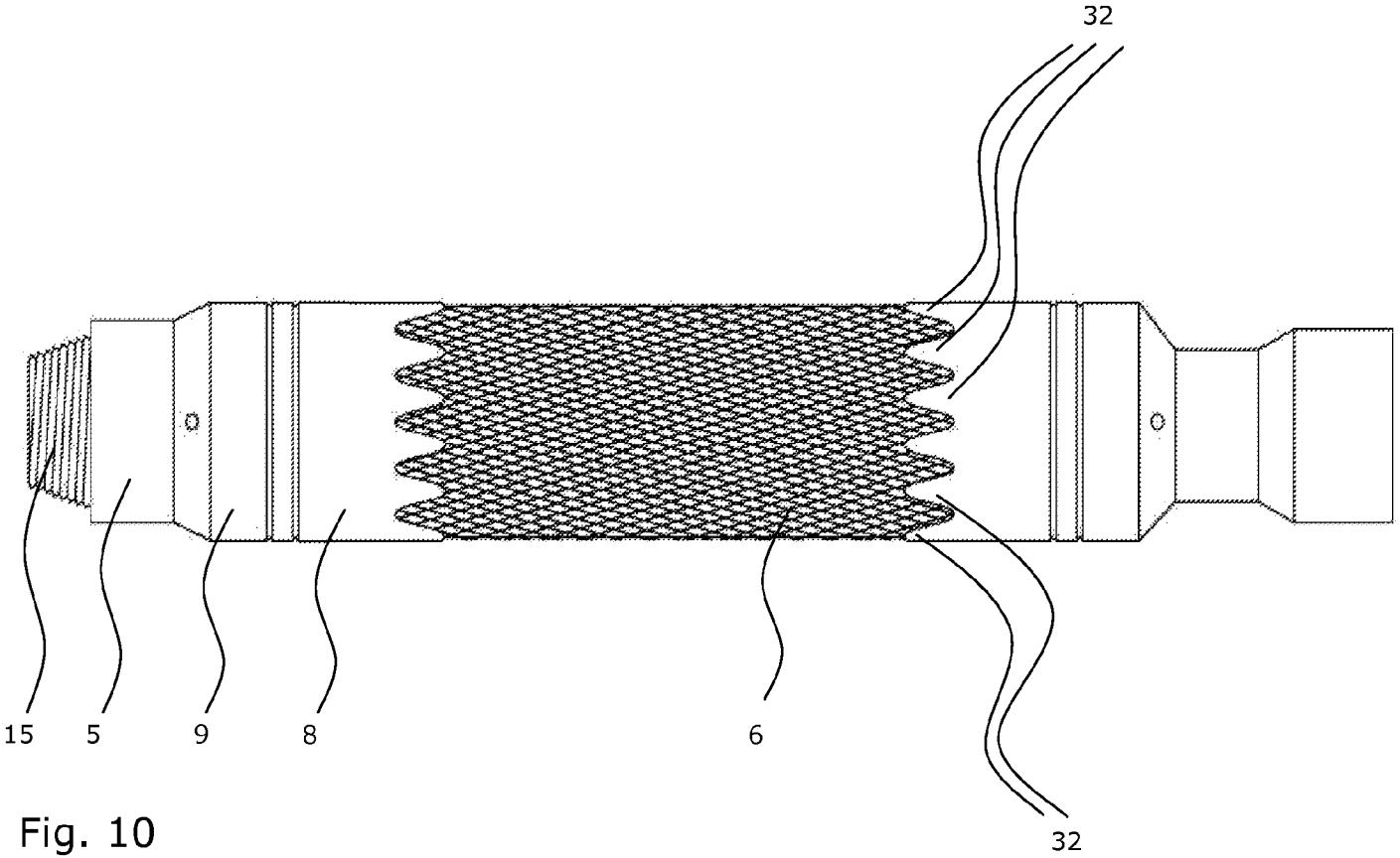
FIG. 10 shows another embodiment of the annular barrier seen from outside the annular barrier.

In one embodiment of the annular barrier 1, the fastening means 8 may have a projecting edge part which projects outwards from the connecting part 9. The projection edge part may also be in the form of tongues 32 as shown in FIG. 9 or 10. Having a part of the fastening means 8 bending outwards means that the fastening means does not have a sharp edge which may cause the sleeve 6 to crack close to the fastening means when expanded.

The expandable sleeve 6 of the annular barrier 1 may be made of metal or polymers, such as an elastomeric material, silicone, or natural or syntactic rubber.

When expanding the expandable sleeve 6, the expandable sleeve often expands in an uneven way and it is therefore manufactured having a varying wall thickness in order to compensate for the uneven expansion.

The expandable sleeve 6 is often made of metal and, in order to improve the sealing ability of the expandable sleeve towards the inside wall of the borehole, the expandable sleeve may be provided with sealing rings 33, such as rings of polymers, rubber, silicone, or the like sealing material.

Also, the expandable sleeve 6 may comprise a mesh, as shown in FIG. 10, to protect the sleeve from damage when being run into the well along with the well tubular structure 3.

Figure 12:
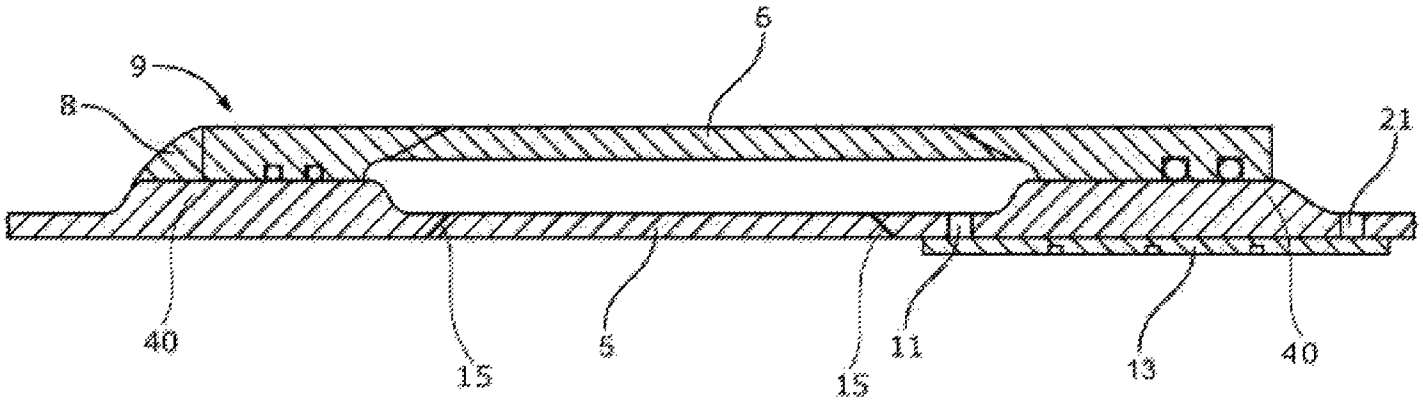
FIG. 12 shows a cross-sectional view of the annular barrier.

In FIG. 12, a cross-sectional view of an annular barrier is shown having a valve which is slidable so as to open and/or close the openings 11, 21. The sleeve of the annular barrier has two end parts welded on each end of a centre sleeve part. The two end parts have a surface inclining towards the centre part corresponding to an inclining surface on each end of the centre part. Due to the inclined surface, the welding area is increased, and due to a three parts sleeve, the two ends may be made of a different material with higher ductility than the centre part, meaning that it stretches easily when the sleeve is expanded. Thus, the centre part of the expandable sleeve may be made of a material with a higher strength, which is able to withstand a high hydraulic collapse pressure when the sleeve is expanded.

Figure 13:
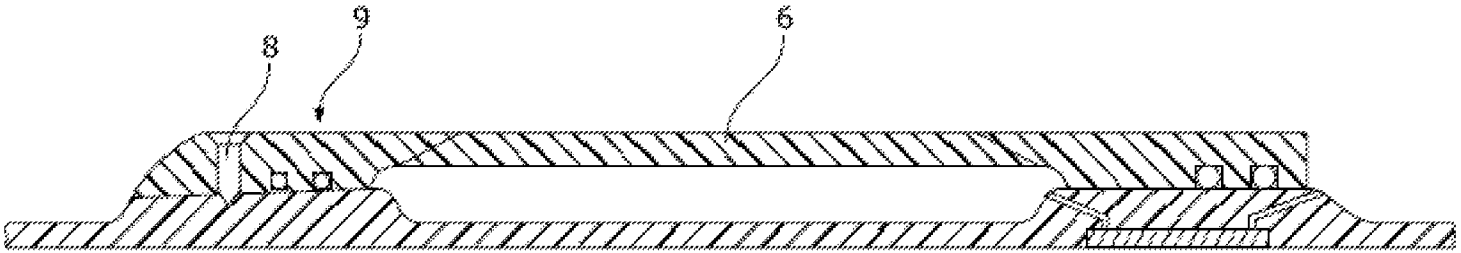
FIG. 13 shows a cross-sectional view of another embodiment of the annular barrier.

In the annular barrier of FIG. 13, the fastening means is a screw connection enabling the sleeve of the annular barrier to be screwed onto the connection part of the tubular part.

The tubular part shown in FIGS. 12-15 has an increased wall thickness in the connection part of the tubular part opposite the ends of the sleeve. By having an increased wall thickness, the outer diameter is increased correspondingly. By having the increased thickness, the surface can be machined to make the surface smoother and to make the outer diameter more exact without decreasing the resulting outer diameter of the tubular part. The sleeve is fastened in one end of the connection part of the tubular part, and in the other end, the sleeve is slidably connected to the other connection part of the tubular part. A sealing means is arranged so as to make a sealing connection between the sleeve and the connection parts.

Figure 14:
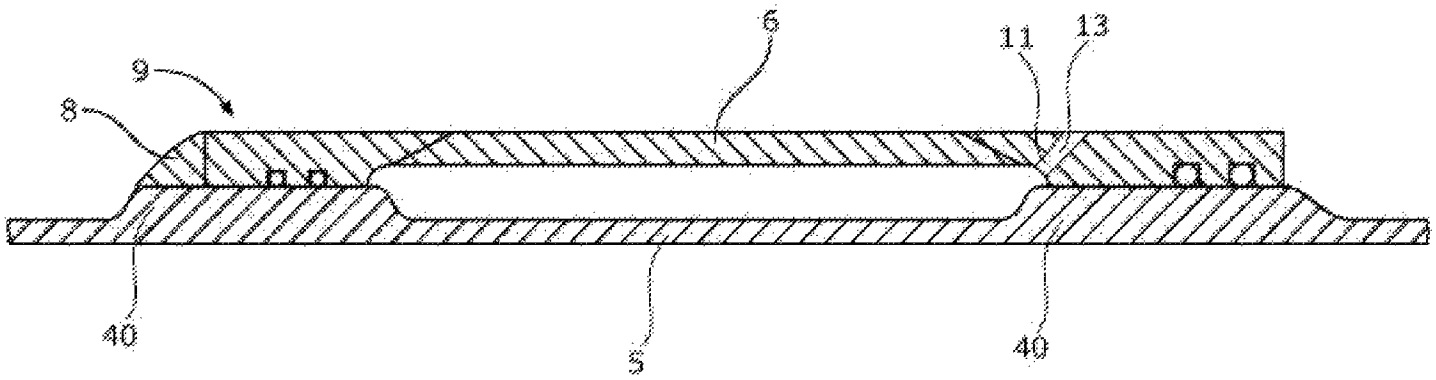
FIG. 14 shows a cross-sectional view of yet another embodiment of the annular barrier.
Figure 15:
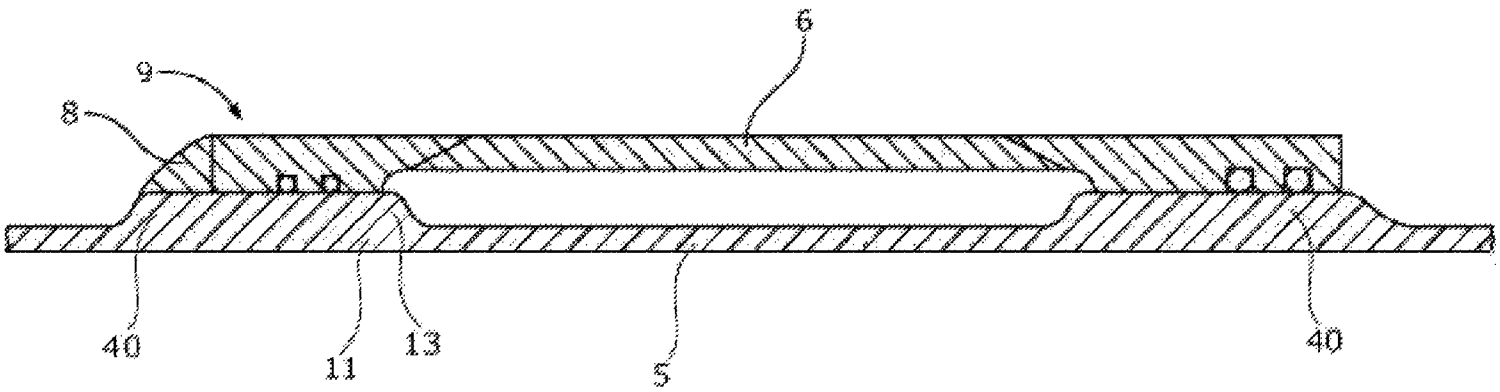
FIG. 15 shows a cross-sectional view of yet another embodiment of the annular barrier.

In the annular barrier of FIGS. 12, 14 and 15, the fastening means is a welding seam since the sleeve is welded to the connection part of the tubular part forming part of the tubular structure.

The connection part projecting from the tubular part increasing the thickness of the tubular structure may be a layer welded onto the connection part or by other means applied as a layer onto the connection part, for instance sprayed onto the surface. In another embodiment, the connection is initially moulded with increased thickness. The layer applied onto the connection part may be made of a different material which is easier to machine into a precise diameter and a smoother surface than the material normally used for making tubular structures.

Figure 5:
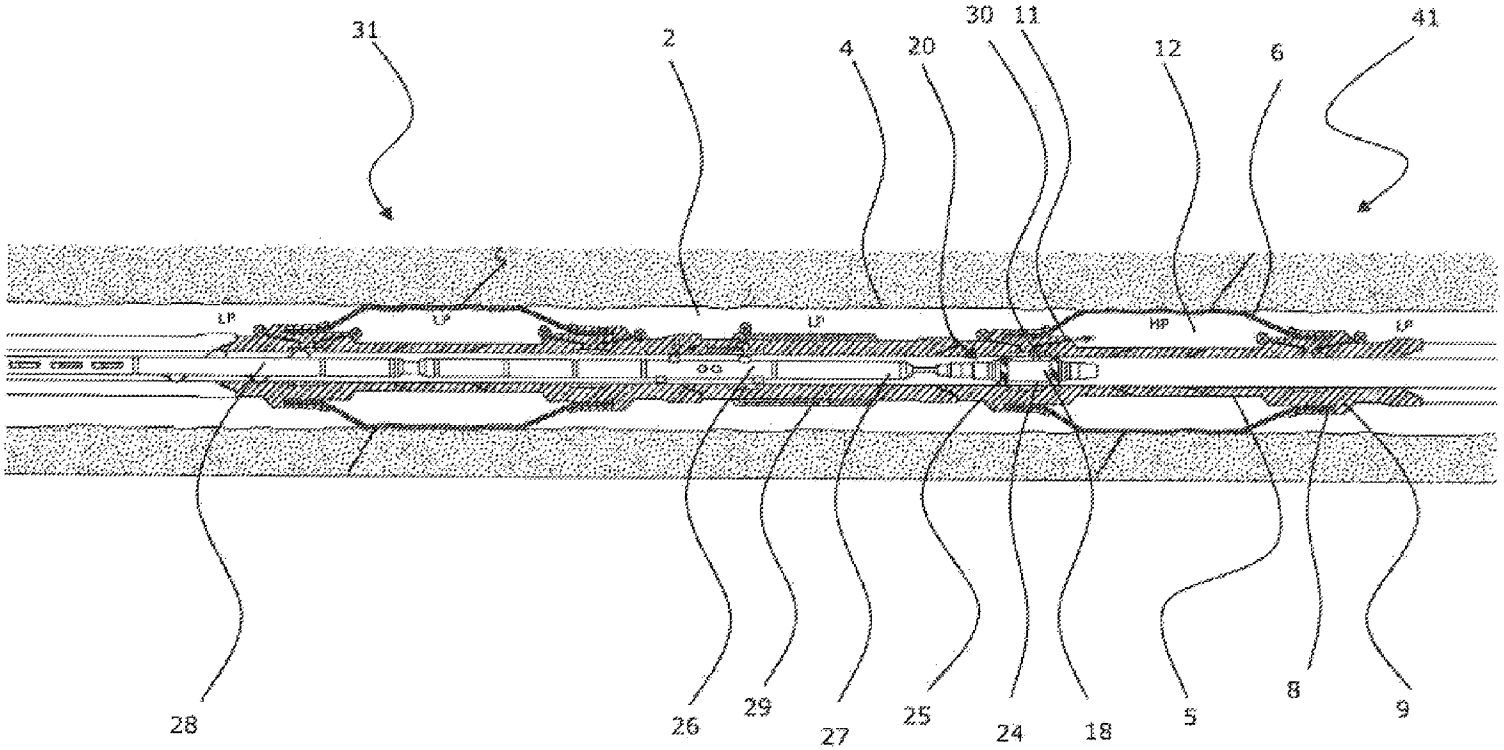
FIG. 5 shows an annular barrier system according to the invention.

Furthermore, the invention relates to an annular barrier system 100 comprising the above-mentioned annular barrier 1. Such as annular barrier system 100 is shown in FIG. 5, where the annular barrier system comprises a tool 20 for expanding the expandable sleeve 6 of the annular barrier 1. The tool 20 expands the expandable sleeve 6 by applying a pressurised fluid through a passage 11 in the tubular part 5 into the space 12 between the expandable sleeve and the tubular part.

In this embodiment, the tool 20 comprises an isolation device 18 for isolating a first section 24 outside the passage 11, 21 between an outside wall 30 of the tool and the inside wall 16 of the well tubular structure. The pressurised fluid is created by increasing the pressure of the fluid in the isolation device 18. By isolating a section 24 of the well tubular structure 3 outside the passage 11, 21 of the tubular part 5, the fluid in the whole well tubular structure no longer has to be pressurised and no additional plug is needed as is the case in prior art solutions.

In order to isolate the isolated section 24, the tool 20 comprises at least one sealing means 25 for sealing against the inside wall of the well tubular structure 3 on each side of the valve 13 in order to isolate the first section 24 inside the well tubular structure. The sealing means 25 is shown as two separate sealing means, but may as well be just one means which is expandable in two positions. The sealing means 25 may be made of an expandable polymer which is inflated by the well fluid or a gas comprised in a reservoir in the tool 20. When the isolation device 18 is no longer needed, the sealing means 25 is deflated and the tool 20 may be retracted.

In that it is able to isolate a section 24 in the well tubular structure 3, this tool 20 can be used for injecting cement into the cavity in known annular barriers in order to expand the expandable sleeves of known annular barriers. In this case, no valve is needed due to the fact that the cement hardens and the cavity thus does not have to be closed in order to keep the cement inside the cavity.

In another embodiment, the pressurised fluid is well fluid, i.e. the fluid present in the well tubular structure 3, and the tool 20 has a suction means for suction of fluid into the tool and out into the isolated section 24 or directly into the passage 11, 21.

When the tool 20 has expanded the expandable sleeve 6 by pressing fluid into the space or cavity 12 between the expandable sleeve and the tubular part 5 of the annular barrier 1, the passage 11 has to be closed in order to stop the fluid from running back into the well tubular structure 3 when the tool is retracted. In this embodiment, the passage 11 is controlled by means of a valve 13.

In order to control the valve 13, the tool 20 has means for adjusting the valve from one position to another position, e.g. from an open position to a closed position. In one embodiment, the means for adjusting the valve 13 is a key engaging indentations 34 in the valve in order to move the valve.

In FIG. 5, the tool 20 is shown having a stroker tool 27 for letting pressurised fluid into the first section.

The annular barrier system 100 of FIG. 5 comprises two annular barriers 1 positioned at a distance from each other along a production zone 29 in the well tubular structure 3. One annular barrier 1, 31 has already been inflated, e.g. in order to centralise the well tubular structure 3 in the borehole or in a previous run to isolate the production zone together with the second annular barrier 1, 41. When expanding the expandable sleeve 6 of the second annular barrier 41, the valves 13 of the first annular barrier 31 are closed (illustrated by circles with a cross).

In one embodiment, the system 100 comprises a plurality of annular barriers 1 fluidly connected by means of a fluid connection, such as a tube running on the outside of the well tubular structure 3 so that, by expanding one annular barrier, a pluralities of annular barriers can be expanded in turn. In this way, the tool 20 can expand all the subsequent barriers 1 by injecting a pressurised fluid into the first annular barrier.

Thus, the tool 20 only has to be lowered into the top part of the well and not all the way into the well.

When producing, the well tubular structure 3 is often perforated to allow the oil fluid to flow into the well tubular structure and further on to the surface of the well. Thus, the annular barriers 1 cannot be expanded by building up a pressure within the well tubular structure 3, such as by means of coiled tubing. By linking the annular barriers 1 by a fluid connection, also annular barriers arranged below the perforations can be expanded without sealing off a zone around each annular barrier.

When linking annular barriers 1 together via a fluid communication as mentioned, the first annular barrier is expanded in order to expand also the subsequent barriers. The first barrier 1 can be expanded by a tool 20 by means of the isolation device 18 or by temporarily plugging the well beneath the first barrier and applying a pressure of fluid from the surface.

In the event that the tool 20 cannot move forward in the well tubular structure 3, the tool may comprise a downhole tractor, such as a Well Tractor®.

The tool 20 may have several stroker tools 27 in order to expand several expandable tubular sleeves 6 at a time. The tool 20 may have more than one isolation device 18 and thus be able to operate several annular barriers 1 at the same time, e.g. expanding several sleeves 6 or measuring the conditions of a production zone 29, the annulus 2, and/or the inside pressure of the expanded annular barrier.

The tool may also be a drill pipe assembly arranged as part of the drill pipe, e.g. in the end of a drill pipe. In this embodiment, the tool is in the same way arranged opposite the sleeve and thereby isolates a zone by means of a sealing means 25. The drill pipe is closed in the bottom by letting a ball into the drill pipe, closing the bottom when landing in the known ball catcher. Subsequently, the drill pipe, and thereby the zone, are pressurised in order to expand the sleeve.

The tool connected to the drill pipe may also be is inserted into the tubular structure, and packers are expanded between the inside wall of the tubular structure and the outside wall of the drill pipe. The tool further comprises means for closing the top of the tubular structure or of the well. Subsequently, the annular area between the drill pipe and the tubular structure is pressurised in order to expend the sleeve. The drill pipe may also be called an inner wash down string.

In another embodiment, the tool has means for closing a zone on the inside of the tubular structure. The means closes the tubular structure in the top of the well and in a position on the other side of the sleeve to be expanded. Then, the zone inside the tubular structure is pressurised in order to expand the sleeve.

The tool 20 may have means for measuring the flow, temperature, pressure, density, water hold-up, and/or expansion of the sleeve 6. When measuring flow, temperature, pressure, density, and/or water hold-up, the conditions of the production zone 29 can be evaluated.

In order to evaluate the data from the measurements, the tool 20 has a recording and/or transmitting device for recording and/or transmitting data from measurements performed by the tool.

Figure 7:
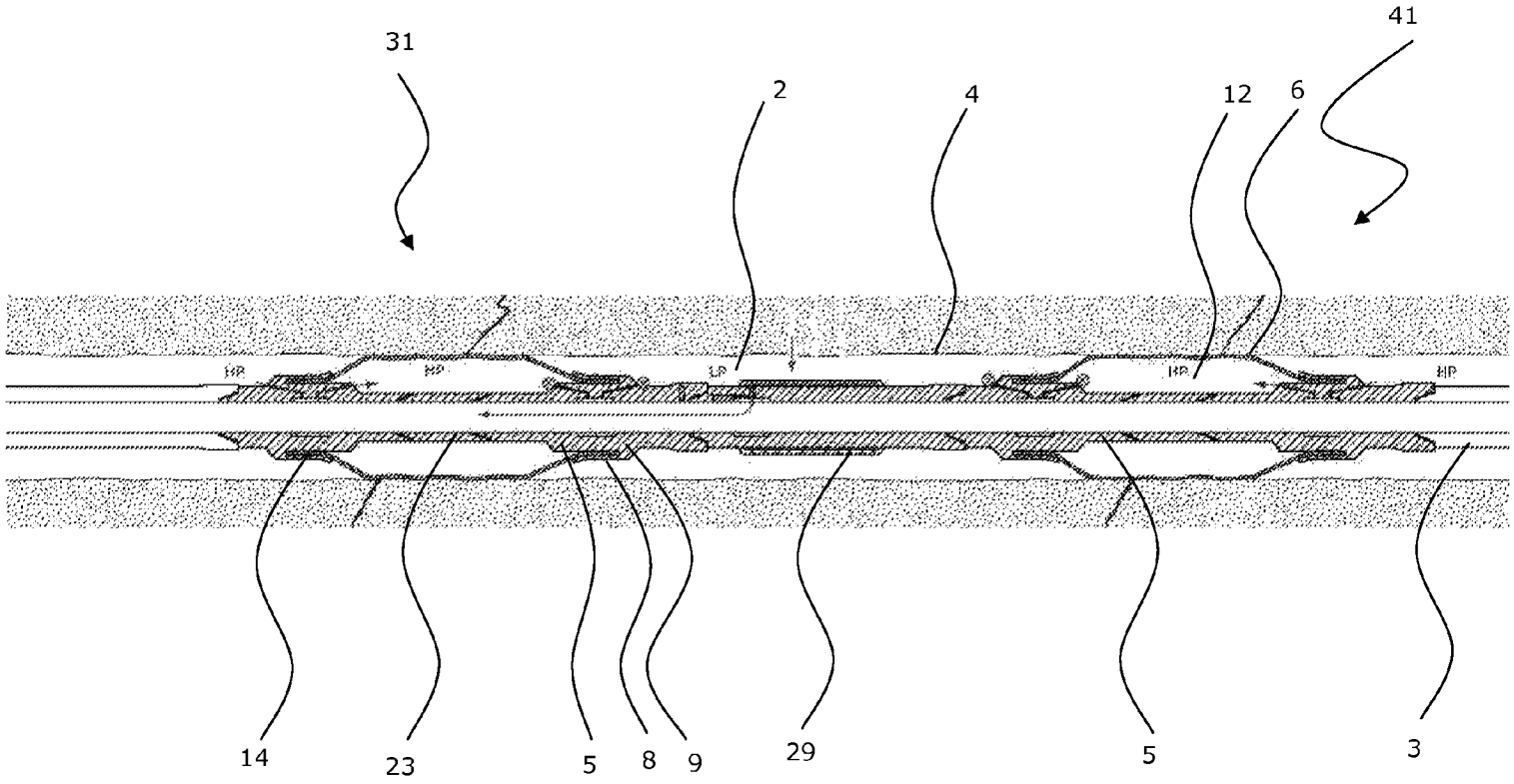
FIG. 7 shows a well tubular structure with annular barriers according to the invention in a production state.
Figure 8:
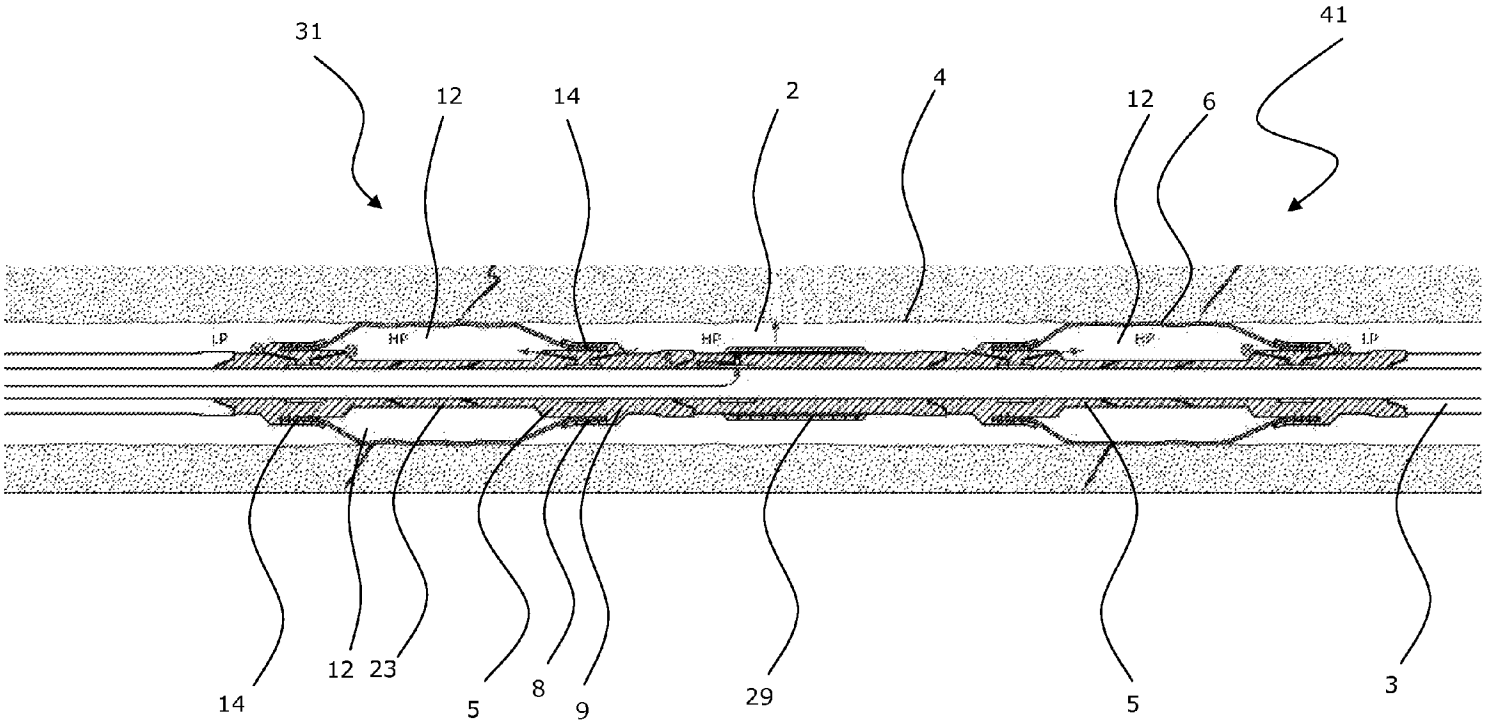
FIG. 8 shows a well tubular structure with annular barriers according to the invention in a fracturing state.

It may also occur that the pressure on one side of an expanded annular barrier 1 is larger than the pressure within the cavity 12 of the annular barrier. The fluid from the high-pressure zone HP may thus try to undermine the connection between the expandable sleeve 6 and the inside wall of the borehole in order to equalise the pressure difference. In this case, the tool 30 opens the valve 13 of the annular barrier 1, allowing fluid to flow from the high-pressure zone into the annular barrier as shown in FIG. 7. In this way, it is ensured that the fluid from a high-pressure zone does not break the seal between the expanded annular barrier 1 and the inside wall of the borehole.

Figure 6:
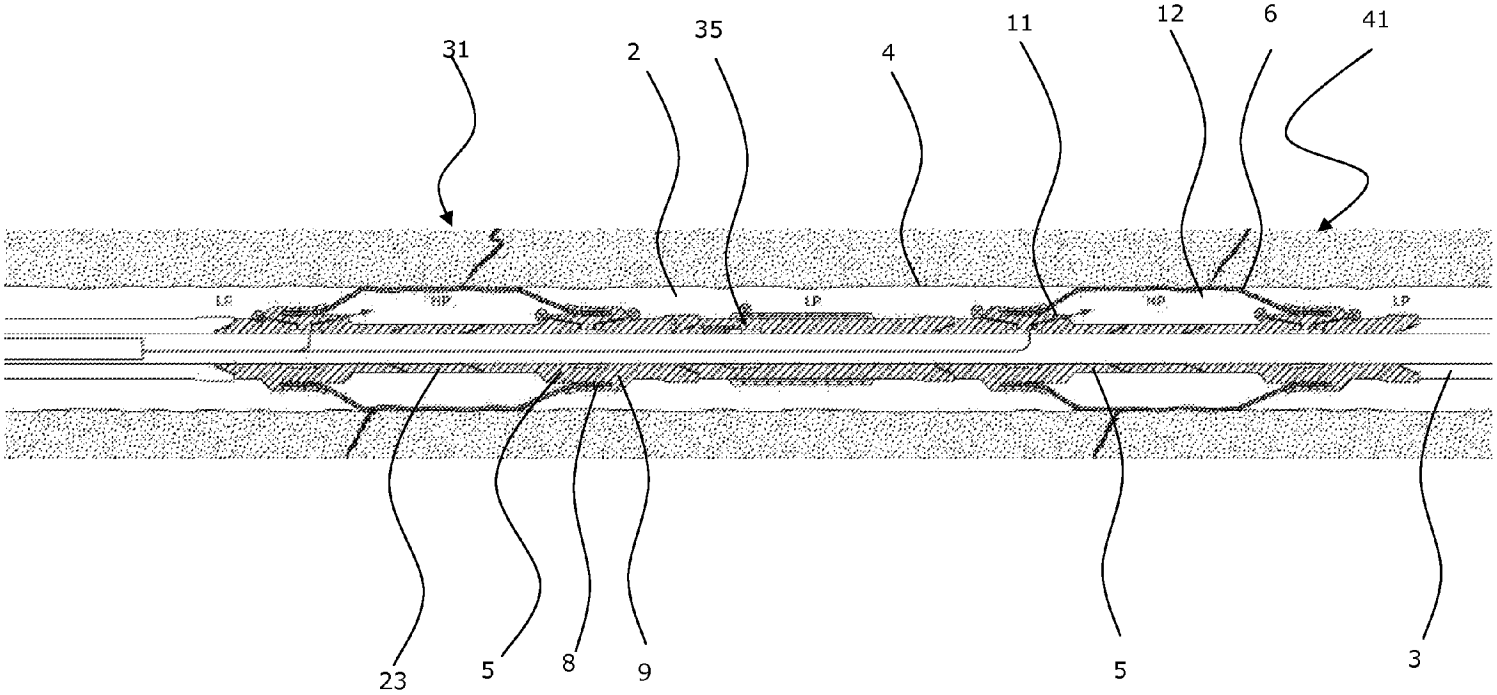
FIG. 6 shows a another embodiment of the annular barrier system of the invention.

The tool 20 of FIG. 6 uses coiled tubing for expanding the expandable sleeve 6 of two annular barriers 1 at the same time. A tool 20 with coiled tubing can pressurise the fluid in the well tubular structure 3 without having to isolate a section 24 of the well tubular structure; however, the tool may need to plug the well tubular structure further down the borehole from the two annular barriers 1 to be operated.

The annular barrier system 100 of the present invention may also expand the sleeve 6 by means of a drill pipe or a wireline tool, such as the one shown in FIG. 5.

The annular barrier system 100 may comprise an anchor tool 26 for anchoring of the tool 20 inside the well tubular structure 3 when operating the annular barriers 1, as shown in FIG. 5.

In one embodiment, the tool 20 comprises a reservoir containing the pressurised fluid, e.g. when the fluid used for expanding the sleeve 6 is cement, gas, or a two-component compound.

In FIG. 6, two annular barriers 1 are inflated simultaneously into having a pressure higher than that of the annulus 2. Hereby, it is ensured that the annular barriers 1 seal properly against the inside wall of the borehole. The flow of the pressurised fluid is illustrated by arrows. When the annular barriers 1 have been expanded, the well tubular structure 3 is centralised in the borehole and ready to use for production of oil.

The annular barriers 1 during production are shown in FIG. 7, where the valves 13 of the annular barriers have been closed and the production valve 35 is in fluid communication with the production screen and thus the production zone 29 of the formation. During production, the valves 13 controlling the passage from the non-production zone of the annulus 2 and the cavity 12 are opened so that the pressure of well fluid in the cavity is the same as the pressure of well fluid in the non-production zone. The arrow inside the well tubular structure 3 illustrates the flow of oil. This ensures that the highest pressure in relation to the formation pressure is maintained within the cavity 12, thereby reducing the differential pressure across the expandable sleeve 6.

The annular barriers 1 of the present invention may also be used when fracturing the formation in order to enable oil to run out of the formation at a higher rate. An annular barrier 1 is expanded on each side of the future production zone 29. Pressurised well fluid or water is injected through the production valve 35 and thus through the production screen 29 in order to crack and penetrate the formation. While fracturing, one of the valves 13 in each annular barrier 1 is adjusted so that the pressurised fluid in the fracturing zone also flows into the cavity 12 of the annular barriers 1, reducing the risk of the fluid undermining the seal between the sleeve 6 and the inside wall of the borehole, and also reducing the risk of the expandable sleeve collapsing inwards. The other valve 13 in each annular barrier 1 is kept closed.

An annular barrier 1 may also be called a packer or the like expandable means. The well tubular structure 3 can be the production tubing or casing or a similar kind of tubing downhole in a well or a borehole. The annular barrier 1 can be used both in between the inner production tubing and an outer tubing in the borehole or between a tubing and the inner wall of the borehole. A well may have several kinds of tubing and the annular barrier 1 of the present invention can be mounted for use in all of them.

The valve 13 may be any kind of valve capable of controlling flow, such as a ball valve, butterfly valve, choke valve, check valve or non-return valve, diaphragm valve, expansion valve, gate valve, globe valve, knife valve, needle valve, piston valve, pinch valve, or plug valve.

The expandable tubular metal sleeve 6 may be a cold-drawn or hot-drawn tubular structure.

The fluid used for expanding the expandable sleeve 6 may be any kind of well fluid present in the borehole surrounding the tool 20 and/or the well tubular structure 3. Also, the fluid may be cement, gas, water, polymers, or a two-component compound, such as powder or particles mixing or reacting with a binding or hardening agent.

The means for measuring the flow, temperature, pressure, density, water hold-up, and/or expansion of the sleeve 6 may be any kind of sensors. The sensor for measuring the expansion of the sleeve 6 may be e.g. a strain gauge.

The recording device may have a memory. The transmitting device may transmit data by means of wireless communication, fibre optic, wireline, or fluid telemetry.

Although the invention has been described in the above in connection with preferred embodiments of the invention, it will be evident for a person skilled in the art that several modifications are conceivable without departing from the invention as defined by the following claims.

The invention claimed is:

1. An annular barrier system for expanding an annular barrier in an annulus between a well tubular structure and an inside wall of a borehole downhole, comprising:

an annular barrier having a tubular part to mount a part of the well tubular structure, the annular barrier further comprising an expandable sleeve surrounding the tubular part, each end of the expandable sleeve being fastened by a fastener of or to a connection part in the tubular part, and the expandable sleeve is made of metal, wherein the annular barrier has a valve to control a passage of pressurised fluid into a space between the expandable sleeve and the tubular part, and wherein the valve is a a three-way valve; and the valve is configured to regulate a flow of pressurized fluid:

(1) between (a) the space between the expandable sleeve and the tubular part and (b) an interior of the tubular part;

(2) between (a) the space between the expandable sleeve and the tubular part and (b) the annulus surrounding the tubular part between the well tubular structure and the inside wall of the borehole; and (3) between (a) the interior of the tubular part and (b) the annulus surrounding the tubular part between the well tubular structure and the inside wall of the borehole.

2. An annular barrier system according to claim 1, wherein the annular barrier system further comprises a tool configured to expand the expandable sleeve by letting a pressurised fluid through the valve.

3. An annular barrier system according to claim 1, wherein the tubular part has a wall thickness, and the connection part projects outwardly from the tubular part increasing the wall thickness.

4. An annular barrier system according to claim 1, wherein the tubular part has a wall thickness, and the connection part comprises a layer on the surface of the connection part facing the sleeve increasing the wall thickness of the sleeve.

5. An annular barrier system according to claim 4, wherein the layer is made of a different material than the tubular part and/or the connection part.

6. An annular barrier system according to claim 1, wherein the sleeve has two ends made of a different material than a centre part of the sleeve.

7. An annular barrier system according to claim 6, wherein the two ends have been welded to the centre part.

8. An annular barrier system according to claim 7, wherein at least two annular barriers are fluidly connected via a fluid connection.

9. An annular barrier system according to claim 6, wherein the two ends have an inclined surface corresponding to an inclined surface of the centre part of the sleeve.

10. An annular barrier system according to claim 1, wherein the valve is positioned in at least one of the connection parts.

11. An annular barrier system according to claim 1, wherein the valve is configured to have a first position to let fluid into the space between the expandable sleeve and the tubular part a second position to let fluid into the annulus between the well tubular structure and the borehole, and a third position to stop the fluid from flowing.

12. An annular barrier system according to claim 1, wherein the valve is configured to have a first position to let fluid into the space between the expandable sleeve and the tubular part, a second position to let fluid into the annulus between the well tubular structure and the borehole, a third position to stop the fluid from flowing, and a fourth position to let fluid flow between the annulus and the space.

13. An annular barrier system according to claim 1, wherein the system comprises at least two annular barriers positioned at a distance from each other along the well tubular structure.

14. An annular barrier system according to claim 1, wherein the tool has a connection to a drill pipe.

15. An annular barrier system according to claim 1, wherein the tool has packers for closing an annular area.

16. An annular barrier according to claim 1.

17. A production method for producing oil through a well tubular structure having a production zone in which the well tubular structure has perforations or a screen and at least two annular barriers according to claim 16, the method comprising:

expanding a first annular barrier at one side of the production zone of the well tubular structure, expanding a second annular barrier at another of the production zone of the well tubular structure, and letting fluid into the well tubular structure through the production zone.

18. An expansion method for expanding the annular barrier system according to claim 1 inside the borehole comprising a well fluid having a pressure, the method comprising either:

placing a tool outside the passage of the tubular part of the annular barrier, isolating the passage by means of an isolation device of the tool, and increasing the pressure of the well fluid inside the isolation device in order to expand the sleeve of the annular barrier, or placing the tool outside the passage of the tubular part of the annular barrier, providing the valve located in the connection part of the annular barrier, and opening the valve in the connection part of the annular barrier so that pressurised fluid in coiled tubing, in a chamber in the tool, or in an isolated section between an outside wall of the tool and an inside wall of the well tubular structure is let into the space between the tubular part and the expandable sleeve of the annular barrier in order to expand the sleeve.

19. An annular barrier system for expanding an annular barrier in an annulus between a well tubular structure and an inside wall of a borehole downhole, comprising:

an annular barrier having a tubular part for mounting a part of the well tubular structure, the annular barrier further comprising an expandable sleeve surrounding the tubular part, at least one end of the expandable sleeve being fastened in a fastener of or to a connection part in the tubular part, and a tool configured to expand the expandable sleeve;

wherein a valve is configured to regulate a flow of pressurized fluid:

(1) between (a) the space between the expandable sleeve and the tubular part and (b) an interior of the tubular part;

(2) between (a) the space between the expandable sleeve and the tubular part and (b) an annulus surrounding the tubular part between the well tubular structure and the inside wall of the borehole; and (3) between (a) the interior of the tubular part and (b) the annulus surrounding the tubular part between the well tubular structure and the inside wall of the borehole.

20. An annular barrier system according to claim 19, wherein the tool has an adjuster to adjust the valve from one position to another.

21. An annular barrier system according to claim 19, wherein the tool has an isolation device for isolating a first section between an outside wall of the tool and an inside wall of the well tubular structure outside the passage of the tubular part.

22. An annular barrier system according to claim 21, wherein the isolation device of the tool has at least one seal to seal against the inside wall of the well tubular structure on each side of the valve in order to isolate the first section inside the well tubular structure.

23. An annular barrier system according to claim 3, wherein the tool has a pressure delivery device to take in fluid from the borehole and to deliver pressurised fluid to a first section.

24. The annular barrier system according to claim 19, wherein the tubular part has a wall thickness, and the connection part projects outwardly from the tubular part increasing the wall thickness.

25. The annular barrier system according to claim 19, wherein the tubular part has a wall thickness, and the connection part comprises a layer on the surface of the connection part facing the sleeve increasing the wall thickness of the sleeve.

26. The annular barrier system according to claim 19, wherein the sleeve has two ends made of a different material than a centre part of the sleeve.

27. The annular barrier system according to claim 19, wherein the valve is positioned in at least one of the connection parts.

28. The annular barrier system according to claim 19, wherein the valve is a three-way valve configured to have a first position to let fluid into the space between the expandable sleeve and the tubular part, a second position to let fluid into the annulus between the well tubular structure and the borehole, and a third position to stop the fluid from flowing.

29. The annular barrier system according to claim 19, wherein the valve is configured to have a first position to let fluid into the space between the expandable sleeve and the tubular part, a second position to let fluid into the annulus between the well tubular structure and the borehole, a third position to stop the fluid from flowing, and a fourth position to let fluid flow between the annulus and the space.

30. The annular barrier system according to claim 19, wherein the system comprises at least two annular barriers positioned at a distance from each other along the well tubular structure.

31. An annular barrier system for expanding an annular barrier in an annulus between a well tubular structure and an inside wall of a borehole downhole, comprising:

an annular barrier having a tubular part to mount a part of the well tubular structure, the annular barrier further comprising an expandable sleeve surrounding the tubular part, each end of the expandable sleeve being fastened by means of a fastener of or to a connection part in the tubular part, and the expandable sleeve is made of metal, wherein the annular barrier has a valve to control the passage of pressurised fluid into the space between the expandable sleeve and the tubular part, and wherein the valve is a two-way valve; and the valve is configured to regulate a flow of pressurized fluid:

(1) between the space between the expandable sleeve and the tubular part and the interior of the tubular part;

(2) between the space between the expandable sleeve and the tubular part and an annulus surrounding the tubular part between the tubular part and the inside wall of the borehole.

32. An annular barrier system for expanding an annular barrier in an annulus between a well tubular structure and an inside wall of a borehole downhole, comprising:

an annular barrier having a tubular part for mounting a part of the well tubular structure, the annular barrier further comprising an expandable sleeve surrounding the tubular part, at least one end of the expandable sleeve being fastened in a fastener of or to a connection part in the tubular part, and a tool configured to expand the expandable sleeve;

wherein a valve is configured to regulate a flow of pressurized fluid:

(1) between (a) the space between the expandable sleeve and the tubular part and (b) an interior of the tubular part; and (2) between (a) the space between the expandable sleeve and the tubular part and (b) an annulus surrounding the tubular part between the well tubular structure and the inside wall of the borehole.

* * * * *